US009731496B2

(12) United States Patent
Ioannou

(10) Patent No.: US 9,731,496 B2
(45) Date of Patent: Aug. 15, 2017

(54) METHOD OF MANUFACTURING ROTOGRAVURE CYLINDERS

(71) Applicant: PARAMOUNT INTERNATIONAL SERVICES LTD., Majuro (MH)

(72) Inventor: Ioannis Ioannou, Rodopoli Attkis (GR)

(73) Assignee: Paramount International Services Ltd., Majuro (MH)

( * ) Notice: Subject to any disclaimer, the term of this patent is extended or adjusted under 35 U.S.C. 154(b) by 0 days.

(21) Appl. No.: 14/912,648

(22) PCT Filed: Aug. 29, 2013

(86) PCT No.: PCT/EP2013/067895

§ 371 (c)(1),
(2) Date: Feb. 18, 2016

(87) PCT Pub. No.: WO2015/028064

PCT Pub. Date: Mar. 5, 2015

(65) Prior Publication Data

US 2016/0200089 A1 Jul. 14, 2016

(51) Int. Cl.
*B41N 1/20* (2006.01)
*B41F 3/54* (2006.01)
(Continued)

(52) U.S. Cl.
CPC ..... *B41F 3/54* (2013.01); *B41C 1/00* (2013.01); *B41C 1/05* (2013.01); *B41N 1/20* (2013.01);
(Continued)

(58) Field of Classification Search
CPC ... B41N 1/06; B41N 1/20; B41N 3/04; B41N 3/003; B41N 1/12; B41F 3/54; B41C 1/00; B41C 1/02; B41C 1/05; B41C 1/18
See application file for complete search history.

(56) References Cited

U.S. PATENT DOCUMENTS 4,119,035 A * 10/1978 Reiser ..... B41N 1/10 101/401.1
4,781,801 A * 11/1988 Frisby ..... C25D 3/38 205/151
(Continued)

FOREIGN PATENT DOCUMENTS

JP 03-41485 * 2/1991 ..... G03G 15/08
JP 2000-141931 * 5/2000 ..... B41N 1/06
(Continued)

OTHER PUBLICATIONS

International Search Report and Written Opinion of the International Searching Authority for PCT/EP2013/067895, dated Aug. 4, 2014.
(Continued)

*Primary Examiner* — Blake A Tankersley
*Assistant Examiner* — Marissa Ferguson Samreth
(74) *Attorney, Agent, or Firm* — Cook Alex Ltd.

(57) ABSTRACT

The present invention describes a method for manufacturing rotogravure cylinders with a cylinder base made of aluminum and a single metallic layer on the cylinder surface. The method comprises the construction of the cylinder base, the deposition of the metallic layer on the cylinder surface, the thinning of the cylinder to achieve the required dimensions, the polishing of the cylinder surface and finally the etching of the cylinder with the desired printing pattern. The metallic layer can be any copper alloy that will produce a surface with a Vickers hardness of about 400 HV. The metallic layer is deposited onto the cylinder base using any thermal spraying method. The cylinder surface is then thinned and polished by using any conventional method. Finally, the cylinder is etched to provide a superb cylinder for the printing industry.

20 Claims, 2 Drawing Sheets

(51) Int. Cl.

| | |
|---|---|
| ***B41C 1/00*** | (2006.01) |
| ***B41C 1/05*** | (2006.01) |
| *B41C 1/02* | (2006.01) |
| *B41C 1/18* | (2006.01) |
| *B41N 1/06* | (2006.01) |
| *B41N 1/12* | (2006.01) |

(52) U.S. Cl.
CPC *B41C 1/02* (2013.01); *B41C 1/18* (2013.01); *B41N 1/06* (2013.01); *B41N 1/12* (2013.01)

(56) References Cited

U.S. PATENT DOCUMENTS

| | | | | | |
|---|---|---|---|---|---|
| 5,417,841 | A * | 5/1995 | Frisby | C25D 3/38 | 205/296 |
| 6,040,067 | A * | 3/2000 | Sugawara | B32B 15/01 | 428/336 |
| 7,153,408 | B1 * | 12/2006 | Herdman | B41N 1/06 | 205/151 |
| 8,991,050 | B2 * | 3/2015 | Ioannou | B41N 1/20 | 205/296 |
| 2009/0153961 | A1 * | 6/2009 | Murakami | G02B 5/3025 | 359/485.05 |
| 2009/0301328 | A1 * | 12/2009 | Zahiri | B41F 13/11 | 101/375 |
| 2012/0128970 | A1 * | 5/2012 | Motoe | C22C 33/003 | 428/336 |
| 2012/0240400 | A1 * | 9/2012 | Ioannou | B41N 1/20 | 29/890.1 |
| 2015/0197080 | A1 * | 7/2015 | Ioannou | B41N 1/20 | 101/375 |
| 2015/0259817 | A1 * | 9/2015 | Ioannou | B41C 1/18 | 205/151 |

FOREIGN PATENT DOCUMENTS

| | | | | |
|---|---|---|---|---|
| JP | 2008-143169 | * 6/2008 | | B41C 1/00 |
| WO | 94/26534 | * 11/1994 | | B41N 1/20 |
| WO | WO 94/26534 | 11/1994 | | |
| WO | WO94/26534 | 11/1994 | | |
| WO | 2009/124541 | * 10/2009 | | B41N 1/22 |

OTHER PUBLICATIONS

International Preliminary Report on Patentability for PCT/EP2013/067895, dated Aug. 18, 2015.
GLS Industries Private Limited, Cylinders, www.glsind.com/cylinders.html, dated Jun. 17, 2015.
QuadGraphics Presents PowerPoint Printout, circa 2013.

* cited by examiner

METHOD OF MANUFACTURING ROTOGRAVURE CYLINDERS

FIELD OF THE INVENTION

The present invention relates to a rotogravure cylinder comprising a cylindrical base and an engraving layer. The invention further relates to a method for manufacturing such rotogravure or gravure cylinders and to the use of the rotogravure cylinders, for instance in the printing industry for the printing of packaging materials (by transfer of ink from the printing cylinder to the packaging material), such as for instance Intaglio printing processes.

BACKGROUND OF THE INVENTION

Gravure cylinders comprise of a base cylinder, which is usually made of steel or aluminum (1, FIG. 1), a "soft" copper layer (2, FIGS. 1 and 2, FIG. 2) usually 10 μm thick, a "hard" copper layer usually 0.5 to 1 mm thick (3, FIGS. 1 and 3, FIG. 2) and a protection layer, which is usually a chromium layer typically 6 to 8 μm thick (4, FIGS. 1 and 4, FIG. 2).

The "hard" copper layer is electroplated on the base of the cylinder and forms the surface which is engraved or etched either by chemical or electromechanical (diamond) or electronic (laser) method with the pattern which will be printed (transferred) on the packaging material (paper, plastic film, aluminum foil, etc.). The copper is the dominant surface used for engraving, because it is easy to engrave. The chromium layer on the engraved cylinder protects the surface of the cylinder from the pressure exerted by the doctor blade on the printing cylinder during the printing process (transfer of ink onto the packaging material).

The cylinder body is usually made of steel which satisfies the requirements for precision and small deflection required in the printing process. Alternatively for the printing industry, the cylinder body can be manufactured from a light weight metal like aluminum or an aluminum alloy. Aluminum has specific weight of about 2700 kg/m$^3$, while steel has a specific weight of about 7800 kg/m$^3$. Using aluminum as the cylinder base results in a lighter rotogravure cylinder (by about one third) which means significant reduced transportation costs and safer handling during production phases.

However, aluminum is an electrochemically passive material and it is quite challenging to electro-copper plate it. This has limited the use of aluminium for the base of the cylinder. To the extent that aluminium is used, it requires a plurality of process steps so as to obtain a suitable copper surface for the aluminium body.

One method for the manufacture of rotogravure cylinders comprising an aluminium base, a copper surface and a chrome protection layer is known from WO2011/073695A2. The copper surface is created in a process that comprises several steps.

In a first step, the surface roughness of the underlying cylinder is increased by a mechanical means, such as sand paper, sandblasting. Thereafter, a copper coating of 10-50 μm thickness is deposited in a thermal spraying process. The copper coating is considered to be the substrate for subsequent electroplating. Another surface treatment with sandpaper is then carried out.

In the subsequent step, a pre-copper plating step is carried out, wherein a layer of copper of about 100-300 μm is plated. The copper is plated without hardener, resulting in a Vickers hardness of 100-120 HV.

This step is followed by another copper plating step, using a bath that includes a hardener, so as to obtain a copper engraving layer with preferably a Vickers hardness of 200-240 HV. Such Vickers hardness is known to be optimal for engraving; at lower values, the engraved cell pattern loses definition. In addition, if the hardness exceeds 240 HV, the lifetime of the diamond styli often used to engrave the cylinders during electronic engraving may be reduced. The copper engraving layer of WO2011/073695 is deposited in a thickness of about 200 μm. Finally, a polishing step is carried out to achieve a predetermined surface roughness, suitably in the range of 0.03-0.07 mm.

According to this method, the very hard copper engraving layer is supported with a stack that is less hard. As is well-known, the Vickers hardness of aluminium or an aluminium alloy is relatively low; a medium strength aluminium alloy such as aluminium alloy 6082 is known to have a Vickers hardness of 35 HV. The copper support comprising the copper adhesion layer and particularly the pre-plated layer therewith has an intermediate hardness between the aluminium base and the hard copper layer.

Moreover, in accordance with this method, about half of the at least 0.5 mm copper layer is present as support. This layer thickness is needed, so as to obtain an appropriately homogeneous layer microstructure on top of which the hard copper can be grown.

In further investigations on the cylinders manufactured in accordance with WO2011/073695A2 it was however observed that the reliability of the cylinders was less than desired. Particularly, about 1-5% of the cylinders turned out defect relatively quickly after use by the customer. However, the defects came irregularly, in an unpredictable manner. Such defect clearly resulted in a need for replacement of the defect cylinders, which is undesired.

In another non-prepublished application in the name of the applicant (application number EP12187941.5) the copper support consists of a single layer, and nevertheless matches the difference in properties between the base and the copper engraving layer with a high hardness. The copper particles are suitably deposited in a high velocity spraying process which results in liberation of a significant amount of energy in the form of heat. This heat will warm up the particles so as to melt at least partially. This invention results in light weight gravure cylinders without the drawbacks of previous inventions.

The inherent disadvantage of the prior art is the use of electrolytic baths that constitutes a hazard to the environment and to humans.

SUMMARY OF THE INVENTION

It is therefore a problem of the invention to provide improved rotogravure cylinders as well as a method of manufacturing those.

According to a first aspect of the invention, a rotogravure cylinder is provided, that comprises a cylindrical base and an engraving layer comprising a copper alloy with a surface having a Vickers Hardness in the range of 300-600 HV.

According to a second aspect of the invention, a method of manufacturing such a rotogravure cylinder is provided, comprising the steps of providing a cylindrical base, and depositing of a copper alloy for definition of an engraving layer, which engraving layer has at its surface a Vickers Hardness of 300-600 HV.

It was surprisingly found that the use of an engraving layer with a relatively high hardness meets the requirements of sufficient hardness for engraving and appropriate wear during the printing process. Moreover, it was found that this engraving layer may be deposited without intermediate support layer between the base and the engraving layer, while the adhesion and/or bonding of the engraving layer to the cylindrical base is good, so that no delamination is found.

The Vickers Hardness is preferably in the range of 400-500 HV. Engraving layers with such a hardness turn out to be well adhered to the underlying base and can be engraved well, especially by means of laser etching. It is observed for sake of clarity that the hardness is variable under a process tolerance as well as inaccuracy of measurement. Moreover, the hardness tends to change slightly across the depth of the engraving layer. Therefore, reference is made to the hardness at the surface. This corresponds to well-established methods for measuring Vickers Hardness in the field of rotogravure cylinders.

Preferably, the copper alloy used in the invention comprises an element chosen from the group of zinc, tin, aluminum and nickel as an alloying element.

In one preferred embodiment, brass was used as the surface coating material. Brass is an alloy of copper and zinc; the proportions of zinc and copper can be varied to create a range of brasses with varying properties. Most suitably, a binary brass alloy comprising at least 40 wt % copper, preferably at least 50 wt % copper is used. One preferred embodiment uses an alloy with 25-50 wt % zinc, more preferably 30-45 wt % zinc or even with 35-40 wt % zinc. However, the addition of further alloying elements is not excluded.

While the invention is feasible without any intermediate support layer, it is not excluded that such support layer is present. It may then be provided in a limited thickness, for instance less than 50 μm, preferably less than 30 μm or even less than 20 μm. Such intermediate support layer is more preferably deposited in a high velocity thermal spraying process, as described in the non-prepublished application EP12187941.5, which is included herein by reference.

Preferably, the cylindrical base substantially comprises aluminium, i.e. the base comprises aluminium or an aluminium alloy. Preferably, the aluminum content of the aluminium alloy is at least 90 wt %, more preferably even higher such as at least 95 wt %. More preferably the cylindrical base has a Vickers Hardness of 200-280 HV. It is believed by the inventor, that the aluminium base that is soft relative to conventional steel bases, may absorb shocks and forces that traditionally were absorbed in an intermediate copper layer.

It is an advantage of the present invention that the manufacturing process of gravure cylinder with aluminum base is greatly simplified. Particularly, in one preferred embodiment, a roughening treatment of the surface of the cylinder base may be eliminated. Moreover, plating processes, such as copper plating and chromium plating as used in the prior art may be and preferably are left out.

The engraving layer is suitably deposited with a thermal spraying coating process, in which the material is deposited in the form of particles. More preferably, a high velocity spraying process is used. In such a process, the coating material particles are applied with a high speed onto the cylinder, for instance with a speed of at least 300 m/s. More preferably, the velocity is higher, for instance above 600 m/s or even in the range of 900-1000 m/s. Such a particle velocity typically corresponds with a jet velocity that is even higher, for instance 1,200-1,400 m/s. Suitably, the particles have an average diameter of less than 50 μm, for instance in the range of 40-50 μm. Suitably, the cylinder herein rotates during the deposition process. The particles will impact on the cylindrical base, which results in liberation of a significant amount of energy in the form of heat. This heat will warm up the particles so as to melt at least partially. It is believed that such partial melting leads to better bonding, for instance by means of incorporated compressive stress.

In one embodiment, the engraving layer is deposited with a thickness of at least 300 μm, more preferably at least 400 μm. This thickness is deemed beneficial for stabilisation purposes. The layer thickness may even be higher than this, for instance in the order of 500-800 μm, so as to modify the diameter of the cylinder base. This is for instance suitable in the event of refurbishment of a recycled rotogravure cylinder, such as described in the non-prepublished application PCT/EP2013/050228, which is included herein by reference.

Preferably, the engraving layer is thinned after its deposition, suitably by at least 100 μm, more preferably at least 150 μm. This thinning is for instance carried out by lathing or grinding. A lubricant solution may be applied simultaneously with the cooling. Use is suitably made herein of grinding with a conventional grinding machine with grinding and polishing stones. Such thinning is preferred to ensure that the resulting surface of the engraving layer has a predefined shape, more particularly is most perfectly cylindrical, in accordance with requirements.

More preferably, the surface is then polished to achieve the desired roughness $R_z$ between 0.35 and 0.60 μm, and more preferably between 0.4-0.45 μm. The polished circumferential layer is then suitable for engraving, particularly with laser etching.

It is an advantage of this invention that the resulting rotogravure cylinder surface has the hardness to withstand wear in the printing process without the need for chromium plating. It is also a significant advantage of this invention that the electrolytic plating processes (pre-copper plating, copper plating and chromium plating) may be eliminated.

The invention further relates to the engraving of the formed cylinder with a desired pattern. This is suitably carried out by means of laser engraving.

The invention also relates to the use of the rotogravure cylinder of the invention, provided with an engraved pattern in the engraving layer, for printing onto a substrate. The substrate is more suitably a packaging material, for instance of paper or of polymer film. More preferably, use is made of Intaglio printing.

BRIEF INTRODUCTION OF THE FIGURES

These and other aspects of the invention will be further elucidated with respect to the following figures, wherein:

FIGS. 1, 2, 3 and 4 are not drawn to scale and they are only intended for illustrative purposes. Equal reference numerals in different figures refer to identical parts of the cylinder.

ILLUSTRATED DISCUSSION OF DETAILED EMBODIMENTS

Figure 1:
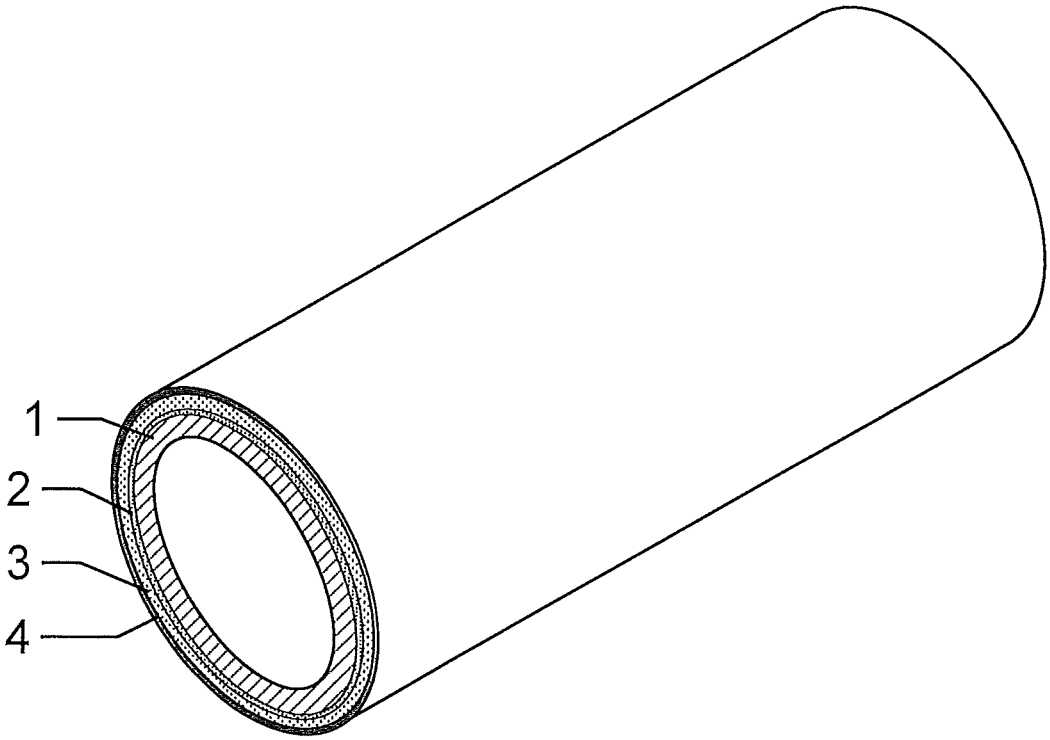
Figure 1 PRIOR ART
FIG. 1 shows a diagrammatical bird's eye view of a rotogravure cylinder.
Figure 2:
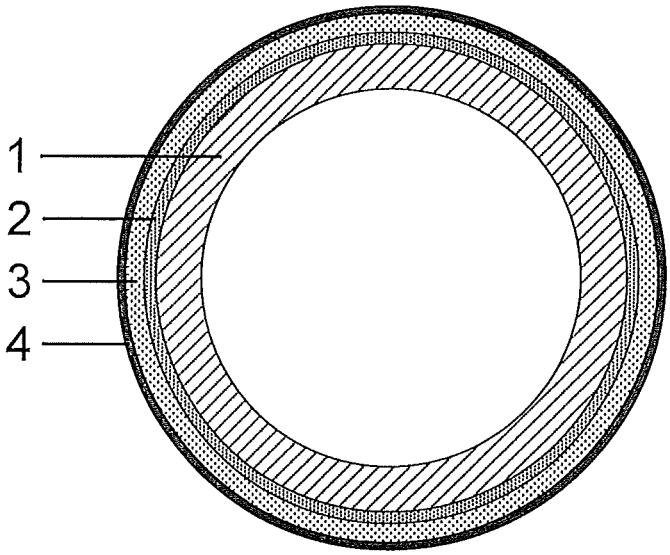
Figure 2 PRIOR ART
FIG. 2 shows a diagrammatical cross-sectional view of the rotogravure cylinder.

The term 'rotogravure cylinders" relates herein to rotogravure cylinders and/or any gravure cylinders used in the printing industry, particularly for the printing of packaging materials. The proposed invention is not limited in any way by the dimensional characteristics of the cylinder.

The term 'cylindrical base' as used in the context of the present invention does not require the base to be a block-like material. Rather the base may be hollow. Alternatively, the base may comprise several layers, such as a steel core and an aluminum top layer. The term aluminum in the present invention refers to pure aluminum, aluminum with small addition of other materials or aluminum alloys.

The coating material refers to any material which can be applied to the surface of the cylinder base to produce a surface suitable for engraving and to withstand the wear of the printing process. Different coating materials will produce a cylinder surface with different hardness. The preferred Vickers hardness of the cylinder surface is in the order of 400-500 HV. In the current invention a number of materials have been used with success, e.g. copper alloys such as copper and zinc, copper and tin, copper and aluminum, copper and nickel, etc.

The term 'at least partial melting' refers to a process wherein at least the surface of individual particles is melted so as to create a homogeneous layer. It is not excluded that inner cores of the said particles remain in solid form. It is moreover not excluded that the circumferential layer created by melting of brass particles is actually an alloy with some aluminium of the underlying cylindrical base. Such an alloy may well be created, particularly close to the interface with the cylindrical base. The composition of the circumferential layer further away from the cylindrical base may thus be different from the composition near to said interface.

Example 1

A gravure cylinder with a conventional steel base was produced to the desired dimensions. The steel cylinder was provided with a coating layer, for instance based on electroplated copper. Brass particles, with an average diameter of less than 50 μm, preferably in the range of 40-45 μm, were sprayed with a thermal spraying method. The brass in use was for instance common brass or high brass, containing 35-40 wt % zinc. During the spraying process, the cylinder was rotated. Impact of the brass particles onto the cylinder resulted in in heating up of the particles, to the extent of at least partial melting. This melting resulted in formation of a single layer extending circumferential around the base. Compressive stress developed in the course of cooling down. This cooling down was achieved by waiting in one embodiment; in an alternative embodiment, jetted air was sprayed onto the cylinder with the circumferential layer.

The engraving layer was deposited in a thickness of approximately 400 μm. This layer was thereafter thinned and polished, by means of a fine grinding process. Use was made of a diamond saw, as known for the sawing of copper or copper-containing elements. The sawing resulted in removal of about 100 μm thickness of brass. A lubricant was sprayed while sawing so as to prevent too much heating of the brass layer. Moreover, herewith a polishing was achieved as well. Use was made herein of grinding with a conventional grinding machine with grinding and polishing stones. The resulting surface roughness $R_z$ was 0.4 μm.

The intermediate product was therewith ready. In a subsequent step, this intermediate product was engraved in accordance with a desired and predefined pattern. Use was made herein of laser engraving.

Example 2

Figure 3:
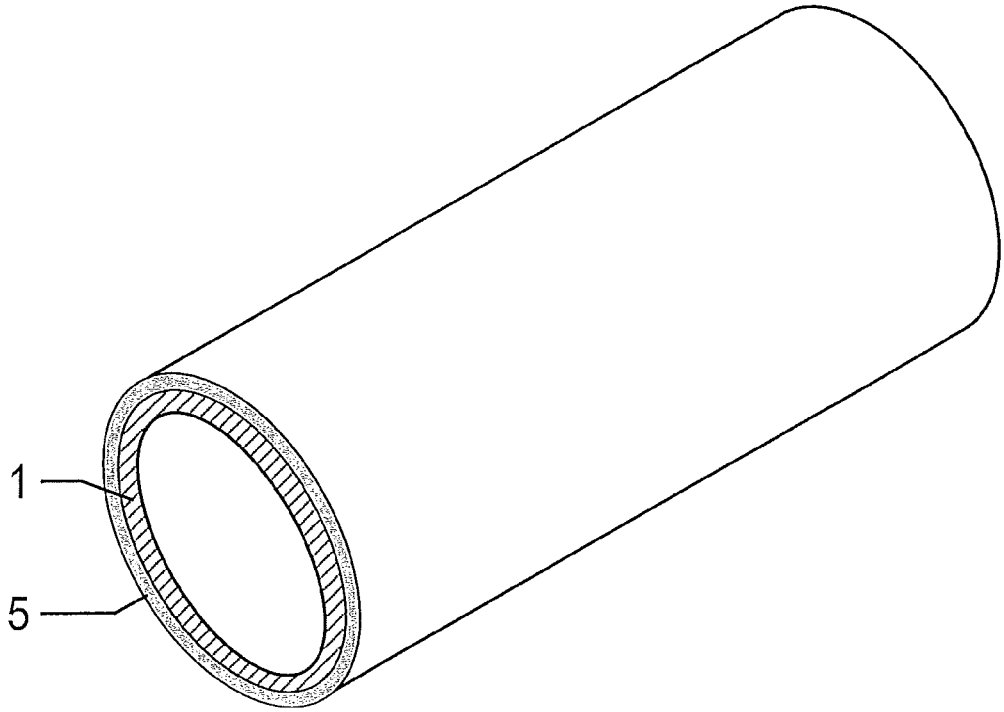
FIG. 3 shows a diagrammatical bird's eye view of the proposed rotogravure cylinder.
Figure 4:
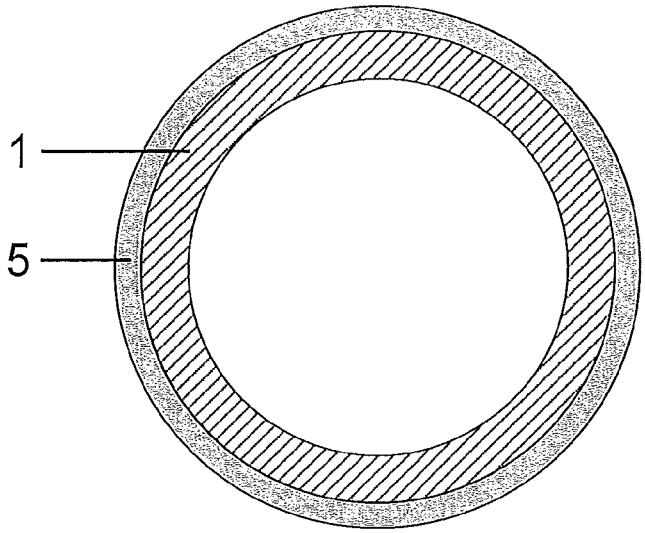
FIG. 4 shows a diagrammatical cross-sectional view of the proposed rotogravure cylinder.

A second gravure cylinder as shown in FIGS. 3 and 4 was produced on the basis of a cylinder with an aluminum base 1. This aluminum base 1 was produced from an aluminum tube to the desired dimensions. The brass particles of the type used in Example 1 were sprayed onto the aluminum base directly by means of high-velocity thermal spraying, in which the particle speed was generally above 300 m/s, typically in the order of 700-1,200 m/s. The thickness of the deposited engraving layer 5 was again set to 400 μm, which was subsequently thinned and polished.

Example 3

The rotogravure cylinder manufactured in accordance with Example 1 was tested. Use was made of Vickers Hardness testing. This testing, standardized per se under ASTM E92 and ISO6507 was measured with the ultrasonic contact impedance (UCI) measurement, standardized under ASTM A 1038, using a diamond pyramid with a 136° roof angle. Measurement equipment for testing the Vickers Hardness on a surface with UCI measurement is commercially available from various suppliers. The Vickers Hardness is tested at room temperature, i.e. 20-25° C. The resulting Vickers Hardness was 430 HV.

Although the above description is the recommended methodology for the manufacturing of a light weight gravure cylinder with a base made of aluminum and a circumferential single layer engraved appropriately, it is apparent that appropriate deviations or alterations or modifications can be implemented without significant deviations from the present invention.

In summary, the invention relates to a gravure cylinder comprising an base, preferably of aluminium, onto which is deposited an engraving layer comprising a copper alloy. The copper alloy suitably comprising 40-70 wt % copper and 30-50 wt % of a secondary element. This secondary element is most suitably zinc, so as to form brass. An alternative is tin, to form bronze. The engraving layer is deposited by means of thermal spraying of particles, for instance with a diameter of 40-50 μm. The thermal spraying is most preferably a high-velocity thermal spraying process, in which the jet velocity is in the order of 1,000-1,500 m/s, such as 1,200-1,400 m/s. The engraving layer is most suitably provided in a thickness of 250-400 μm after optional thinning so as to harmonize the diameter of the cylinder. Suitably, the engraving layer is provided with a surface roughness $R_z$ in the range of 0.3-0.6 μm, preferably 0.4-0.5 μm. The Vickers Hardness of the layer is suitably in the range of 300-600 HV, more preferably in the range of 400-500 HV. With the use of an engraving layer of such copper alloy, suitably brass as obtainable in a (high-velocity) thermal spraying process, no subsequent coating, such as the conventional chrome coating, is needed anymore. Moreover, any intermediate electroplating layers may be left out. The resulting engraving layer is most suitably engraved by means of laser engraving.

The invention claimed is:

1. A rotogravure cylinder comprising a cylindrical base and an engraving layer comprising a copper alloy with a surface having a Vickers Hardness in the range of 300-600 HV, wherein the surface of the engraving layer constitutes a printing surface and is free of any subsequent protection layer.

2. The rotogravure cylinder as claimed in claim 1, wherein the engraving layer is present directly on the cylindrical base.

3. The rotogravure cylinder as claimed in claim 1, wherein the cylindrical base at least substantially comprises aluminum.

4. The rotogravure cylinder as claimed in claim 1, wherein the copper alloy is a brass comprising copper and zinc.

5. The rotogravure cylinder as claimed in claim 4, wherein the cooper alloy comprises 40-70 wt % copper and 30-50 wt % of zinc as a secondary alloying element.

6. The rotogravure cylinder as claimed in claim 1, wherein the Vickers Hardness is in the range of 400-500HV.

7. The rotogravure cylinder as claimed in claim 1, wherein the engraving layer has a surface roughness $R_z$ between 0.3 and 0.60 μm.

8. Use of the rotogravure cylinder as claimed in claim 1 for printing by transfer of ink from the rotogravure cylinder to a substrate.

9. Use as claimed in claim 8, wherein the printing constitutes the printing of packaging materials.

10. The rotogravure cylinder as claimed in claim 1, wherein the engraving layer is deposited by means of a high velocity thermal spraying method.

11. The rotogravure cylinder as claimed in claim 1, wherein the copper alloy comprises an element chosen from the group consisting of zinc, tin, aluminum and nickel as a secondary alloying element.

12. The rotogravure cylinder as claimed in claim 11, wherein the copper alloy comprises 40-70 wt % copper and 30-50 wt % of the secondary alloying element.

13. Method of manufacturing rotogravure cylinders comprising the steps of:

providing a cylindrical base;

depositing of a copper alloy for definition of an engraving layer by means of high-velocity thermal spraying, which engraving layer has at its surface a Vickers Hardness of 300-600 HV; and engraving the engraving layer, wherein the surface of the engraving layer serves as the printing surface and is free of any subsequent protection layer.

14. The method as claimed in claim 13 wherein the high-velocity spraying process is applied in velocity of at least 300 m/s.

15. The method as claimed in claim 13, further comprising the step of thinning the engraving layer.

16. The method as claimed in claim 13, further comprising the step of polishing the preferably thinned engraving layer.

17. The method as claimed in claim 13, wherein laser engraving is used in the engraving step.

18. The method as claimed in claim 13, wherein the engraving layer is provided with a final thickness in the range of 250-400 μm.

19. Rotogravure cylinder obtainable with the method as claimed in claim 13.

20. The method as claimed in claim 13, wherein the high-velocity spraying process is applied with a particle speed of at least 500 m/s.

* * * * *